US005835612A

United States Patent [19]

Fujihira et al.

[11] Patent Number: 5,835,612

[45] Date of Patent: Nov. 10, 1998

[54] SPEAKER APPARATUS

[75] Inventors: Masao Fujihira, Kanagawa; Makoto Yamagishi, Tokyo; Kazuo Azami, Saitama, all of Japan

[73] Assignee: Sony Corporation, Tokyo, Japan

[21] Appl. No.: 800,631

[22] Filed: Feb. 14, 1997

[30] Foreign Application Priority Data

Feb. 29, 1996 [JP] Japan ..... 8-043805

[51] Int. Cl.[6] ..... H04R 25/00

[52] U.S. Cl. ..... 381/421; 381/414; 381/412

[58] Field of Search ..... 381/192, 194, 381/199, 193, 201, 412, 414, 420, 421, 422; 310/13; 335/222

[56] References Cited

U.S. PATENT DOCUMENTS 3,129,298 4/1964 Hofman ..... 381/199

5,452,366 9/1995 Sakamoto ..... 381/201

5,536,984 7/1996 Stuart et al. ..... 381/199

*Primary Examiner*—Huyen Le

*Attorney, Agent, or Firm*—Jay H. Maioli

[57] ABSTRACT

A speaker apparatus includes a yoke formed of a magnetic material and having a flange portion and a center pole protruded integrally forwards from a mid portion of the flange portion, and a ring-shaped driving magnet into which the center pole is inserted. The speaker apparatus also includes a top plate mounted on the driving magnet. The top plate is formed of a magnetic material and the center pole is inserted through the top plate. The top plate defines a magnetic gap together with the center pole. The speaker apparatus further includes a voice coil mounted on a bobbin secured to a diaphragm in the magnetic gap, and a canceling magnet arranged on the outer periphery of and spaced from the driving magnet at a pre-set spacing for covering the driving magnet. The canceling magnet cancels the magnetic flux leaking to outside a magnetic circuit including the driving magnet.

1 Claim, 6 Drawing Sheets

SPEAKER APPARATUS

BACKGROUND OF THE INVENTION

1. Field of the Invention

This invention relates to a speaker apparatus for transducing electrical signals into acoustic signals.

2. Description of the Related Art

Heretofore, a speaker apparatus has been proposed having a magnetic circuit and in which a voice coil mounted on a movably supported diaphragm is positioned in a magnetic gap of the magnetic circuit. In such speaker apparatus, the diaphragm is oscillated by electrical signals supplied to the voice coil for outputting the speech.

Such speaker apparatus is termed a dynamic type speaker. With the dynamic type speaker, the voice coil, fed with current, is moved together with the diaphragm through a magnetic flux in the magnetic gap for oscillating the diaphragm.

For this speaker apparatus, a magnetic circuit of the external magnet and magnetic shielding type has been proposed. This speaker apparatus has a disc-shaped driving magnet 103 having a center aperture 103*a*, as shown in FIG. 1. This driving magnet 103 has its front portion (upper portion in FIG. 1) and its rear portion (lower portion in FIG. 1) magnetized to North and South polarities, respectively. This center aperture 103*a* of the driving magnet 103 has inserted thereinto a center pole 101 of a yoke 102. The yoke 102 is molded from a magnetic material and has a disc—shaped flange portion on the front surface of which the center pole 101 is mounted as one with the flange portion.

On the front surface of the driving magnet 103 is mounted a disc-shaped top plate 104 of a magnetic material having a center opening 104*a*. The center opening 104*a* of the top plate 104 and the distal peripheral portion of the center pole 101 face each other for defining a magnetic gap 115.

On the back surface of the yoke 102 is mounted a toroidally-shaped canceling magnet 116 having opposite magnetic polarities to those of the driving magnet 103. That is, the front surface and the back surface of the canceling magnet 116 are polarized to South and North polarities, respectively. The canceling magnet 116 is selected so as to have a magnetic force slightly lower than or equivalent to that of the driving magnet 103, that is a magnetic force 70% to 100% of that of the driving magnet 103.

On the back surface of the canceling magnet 116 is mounted a shield cover 117 of a magnetic material. The shield cover 117 has a bottom portion and a rim portion protuberantly formed forward from the periphery of the bottom portion and has an opened front side. This shield cover 117 has the foremost part of the rim portion thereof in proximity to the periphery of the top plate 104 for covering the driving magnet 103, yoke 102 and the canceling magnet 116.

The mid portion of the bottom surface of the shield cover 117 is formed with a protrusion 118 fitted in a center opening 116*a* of the canceling magnet 116 for positioning the shield cover 117 against the canceling magnet 116. On the front surface of the top plate 104 is mounted a frame 108 supporting a conically-shaped diaphragm 105. On the rear end of the diaphragm 105 is mounted the voice coil 107 via a cylindrically-shaped bobbin 106. This voice coil 107 is positioned within the magnetic gap 115.

The diaphragm 105 has a mid through-hole, mounting the bobbin 106, closed by a cap 112. The diaphragm 105 has its rim portion attached to the forward end portion of the frame 108 via edge portion 113. The bobbin 106 is supported via damper 109 by the frame 108. The numeral 114 denotes a gasket mounted on the front surface of the edge portion 113.

A leader line 110 from the voice coil 107 is connected to a terminal portion 111 mounted on the frame 108. This completes the magnetically shielded speaker apparatus.

In the above structure, the canceling magnet 116 cancels the stray magnetic flux from the driving magnet 103 leaking to outside thus increasing the magnetic flux density in the magnetic gap 115.

In the above-described magnetically shielded speaker apparatus, a larger number of components are used, such that it is difficult to reduce the size and weight of the apparatus, while the production and assembling process is complicated.

Since, the present speaker apparatus utilizes the canceling magnet 116 of substantially the same size as the driving magnet 103 and requires the shield case 117 in addition to the frame 108, the number of component parts is increased. As a result the overall weight of the speaker apparatus is increased.

SUMMARY OF THE INVENTION

It is therefore an object of the present invention to provide a magnetically shielded speaker apparatus exhibiting sufficient magnetic shielding properties with a smaller number of components, and which is reduced in size and weight and may be facilitated in production.

According to the present invention, there is provided a speaker apparatus including a yoke formed of a magnetic material and having a flange portion and a center pole protruded integrally forward from a mid portion of the flange portion, and a ring-shaped driving magnet that has the center pole inserted through it. The speaker apparatus also includes a top plate mounted on the driving magnet. The top plate is formed of a magnetic material and has the center pole inserted through it. The top plate defines a magnetic gap together with the center pole. The speaker apparatus further includes a voice coil placed on a bobbin secured to a diaphragm in the magnetic gap, and a canceling magnet arranged on the outer periphery of the driving magnet at a pre-set spacing with respect to the driving magnet for covering the driving magnet. The canceling magnet cancels the magnetic flux leaking to outside a magnetic circuit including the driving magnet.

In the speaker apparatus according to the present invention, the canceling magnet is provided on the outer periphery of and spaced from the driving magnet at a spacing with respect to the driving magnet for encircling its peripheral portion. Thus the magnetic flux from the driving magnet tending to leak to outside the apparatus is canceled mainly by the canceling magnet, thereby reducing any adverse effects of the external magnetic field on other components. In addition, the apparatus may be lightweight and constructed with fewer component parts. Moreover, the driving magnet and the canceling magnet can be magnetized simultaneously for simplifying the production process.

DESCRIPTION OF THE PREFERRED EMBODIMENTS

Figure 1:
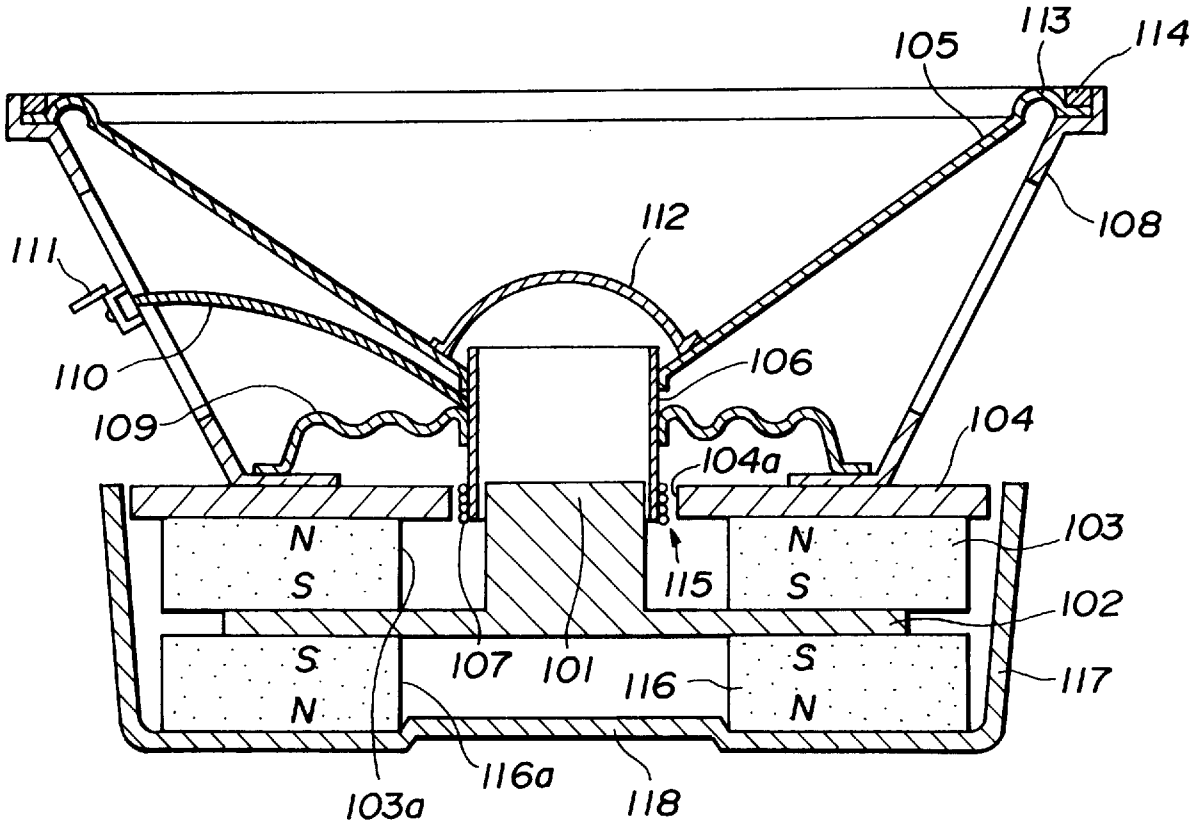
FIG.1 (PRIOR ART)
FIG. 1 is a longitudinal cross-sectional view showing the structure of a conventional speaker apparatus having a shield cover.

Referring to the drawings, preferred embodiments of the present invention will be explained in detail.

Figure 2:
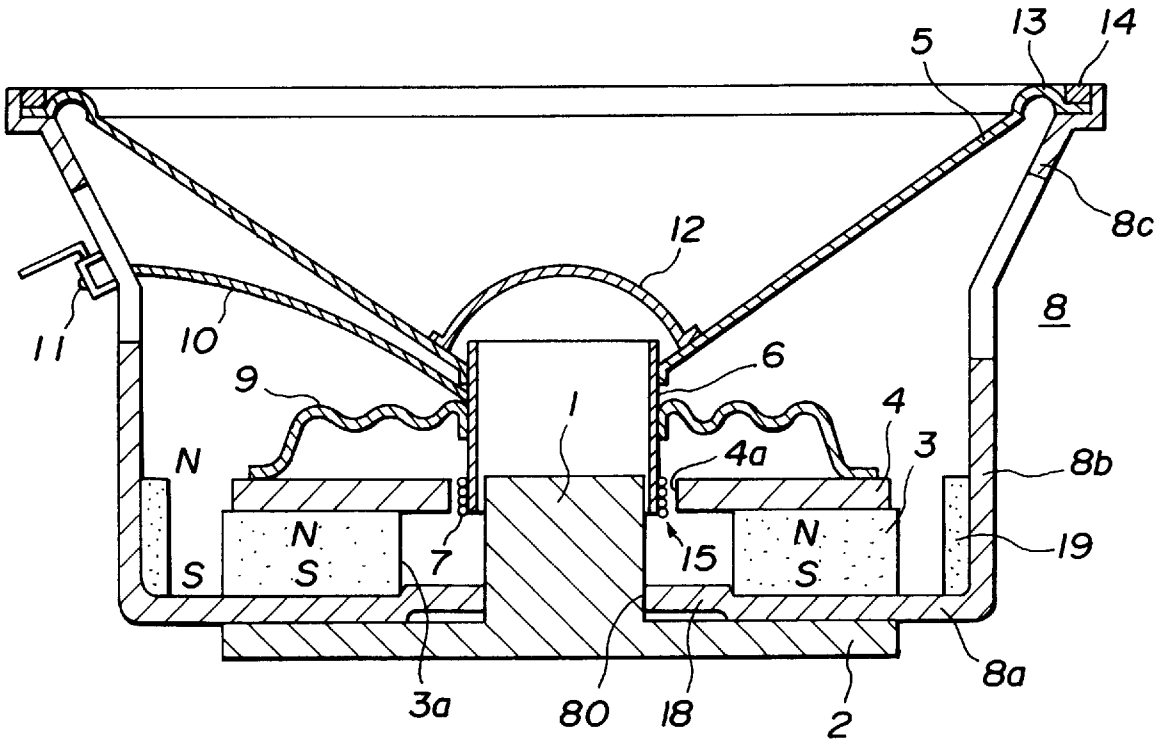
FIG. 2 is a longitudinal cross-section showing the structure of a speaker apparatus according to a first embodiment of the present invention.

FIG. 2 shows a first embodiment of a speaker apparatus according to the present invention. Referring to FIG. 2, the speaker apparatus has a frame 8 of a magnetic material, such as iron. The frame 8 is formed integrally with a substantially disc-shaped bottom portion 8*a*, a rear peripheral side portion 8*b* extending forward (upward in FIG. 2) from the rim of the bottom portion 8*a*, and a forward peripheral side portion 8*c*. The forward peripheral side portion 8*c* is contiguous to the rear peripheral side portion 8*b* and flared toward the front side as far as an opened front side.

At a mid portion of the bottom portion 8*a* extends a forwardly protuberant portion 18, the mid portion of which is formed with a through-hole 80.

A columnar-shaped center pole 1 of the yoke 2 of the magnetic material, formed protuberantly at a mid portion of the front surface of the flange, is introduced through the through-hole 80 from outside into the inside of the frame 8. The front side of the flange portion of the yoke 2 is mounted with an adhesive to the rear side of the bottom portion 8*a* of the frame 8.

On the front side of the bottom portion 8*a* of the frame 8 is mounted a toroidally-shaped driving magnet 3 having a center opening 3*a* with an adhesive. Alternatively, the frame that holds one end of the diaphragm is molded integrally with the driving magnet. The driving magnet 3 is positioned by fitting the rim of the center opening 3*a* onto the outer rim portion of the forwardly protuberant portion 18.

On the front surface of the driving magnet 3 is mounted a disc-shaped top plate 4 of a magnetic material with an adhesive. The top plate is mounted coaxially with the center pole and has a center aperture 4*a*. Into the center aperture 4*a* of the top plate 4 is intruded the distal peripheral portion of the center pole 1.

The inner peripheral surface around the center aperture 4*a* of the top plate 4 and the outer periphery of the distal peripheral side portion of the center pole 1 face each other defining a magnetic gap 15.

The bottom portion 8*a* and the rear peripheral side portion 8*b* of the frame 8 make up a shield case for shielding the driving magnet 3, center pole 1 and the top plate 4.

Figure 6:
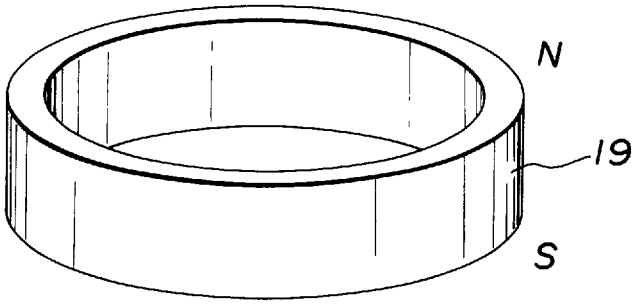
FIG. 6 is a perspective view showing the structure of a canceling magnet of a speaker apparatus according to the present invention.
Figure 7:
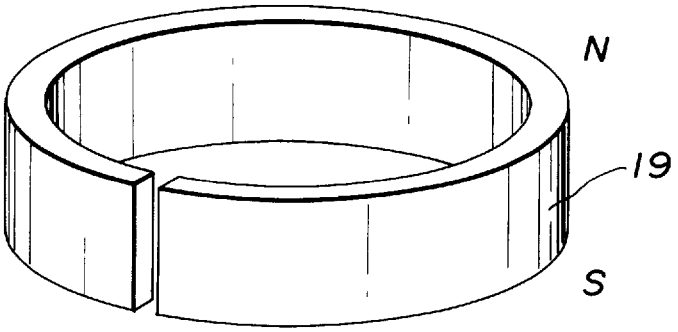
FIG. 7 is a perspective view showing the structure of a modification of a canceling magnet of a speaker apparatus according to the present invention.

On the inner periphery of the rear peripheral side portion 8*b* of the frame 8 is mounted a canceling magnet 19 with an adhesive. This canceling magnet 19 is a so-called rubber magnet or plastic magnet molded in a ring shape as shown in FIG. 6 or in a C-shape as shown in FIG. 7. The rubber magnet or the plastic magnet is produced by mixing ferrite or samarium-cobalt powders in a synthetic resin and magnetizing the resulting mass.

The canceling magnet 19 is mounted on the outer periphery of the driving magnet 3 at a spacing from the driving magnet 3 for covering the driving magnet 3 in its entirety.

This canceling magnet 19 is magnetized to the same magnetic polarities as those of the driving magnet 3. That is, if the front and back sides of the driving magnet 3 are magnetized to North and South polarities, respectively, the front and back sides of the canceling magnet 19 are similarly magnetized to the North and South polarities, respectively.

Meanwhile, the canceling magnet 19 may be simultaneously magnetized with the driving magnet 3 depending on the magnetizing positions. That is, with the present speaker apparatus, after mounting the driving magnet 3 and the canceling magnet 19 on the peripheral wall section of the frame 8 with an adhesive, the driving magnet 3 and the canceling magnet 19 may be magnetized simultaneously.

The magnetic force of the canceling magnet 19 may be weaker than the magnetic force of the driving magnet 3. The role of the canceling magnet 19 is to cancel the stray magnetic flux leaking from the poles of the driving magnet 3 to outside for diminishing the stray magnetic flux. The magnetic flux in the magnetic gap 15 is strengthened in an amount corresponding to the reduction in the stray magnetic flux to outside of the speaker apparatus.

The diaphragm 5 is made up of a substantially conically-shaped cone portion and a dome-shaped cap 12 mounted on the cone portion for closing a center aperture formed in the cone portion. The perimetral portion of the cone portion is formed with an edge portion 13 by which the diaphragm is set on the front end of the frame 8. The edge portion 13 thus set on the frame is fitted with a gasket 14.

At a mid portion of the diaphragm 5 is mounted a bobbin 6 directed rearward. The bobbin 6 is cylindrically-shaped and has its front end mounted on the diaphragm 5. The bobbin 6 is preferably of high toughness and lightweight. Thus the bobbin 6 is formed of a paper or cloth material impregnated with epoxy resin or a synthetic material, such as glass-epoxy (glass fiber material encapsulated with epoxy resin) rounded in a cylindrical shape.

On the outer peripheral surface of the rear end of the bobbin 6 is fitted and secured a voice coil 7. The voice coil 7 has a leader wire (brocade line) 10 wound in a cylindrical shape. The leader line 10 is soldered to a contact portion 11 provided on the front peripheral side portion 8*c* of the frame 8.

The voice coil 7 is positioned in the magnetic gap 15. That is, the voice coil 7, wound about the bobbin, is positioned co-axially with the center pole 1 and intruded into the magnetic gap 15 between the center pole 1 and the inner surface of the center through-hole 4*a* in the top plate 4.

In the present speaker apparatus, the voice coil 7 is fed with the electrical current through the contact portion 11 and the leader line 10, so that the voice coil 7 is moved within the magnetic flux in the magnetic gap 15 together with the diaphragm 5 for oscillating the diaphragm for, thereby generating the acoustic sound.

In the above-described structure of the speaker apparatus, the magnetic flux leaking from the driving magnet 3 to outside the speaker apparatus is canceled mainly by the canceling magnet 19 for reducing the adverse effect of the magnetic flux of the external magnetic field on other components.

In the above-described structure of the speaker apparatus, since the shield cover for covering the driving magnet 3, center pole 1 and the top plate 4 is formed as one with the frame 8, the number of component parts may be reduced, while the apparatus may be reduced in size and weight.

Figure 3:
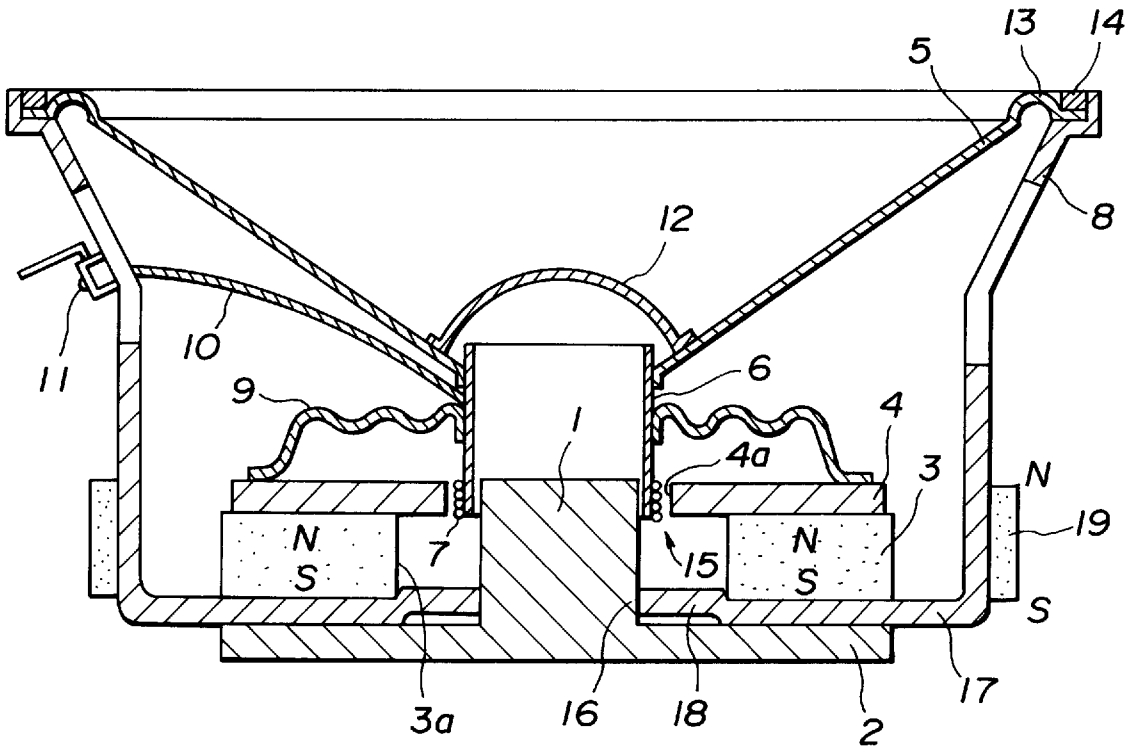
FIG. 3 is a longitudinal cross-section showing the structure of a speaker apparatus according to a second embodiment of the present invention.

FIG. 3 shows a second embodiment of the present invention, in which the parts or components similar to those shown in FIG. 2 are denoted by the same numerals and the corresponding description is omitted for simplicity. In the present second embodiment, shown in FIG. 3, the canceling magnet 19 is affixed to the outer wall surface of the peripheral wall section of the frame 8, that is to the outer wall section of the shield casing, for realizing an effect similar to that derived from the previous first embodiment.

Figure 4:
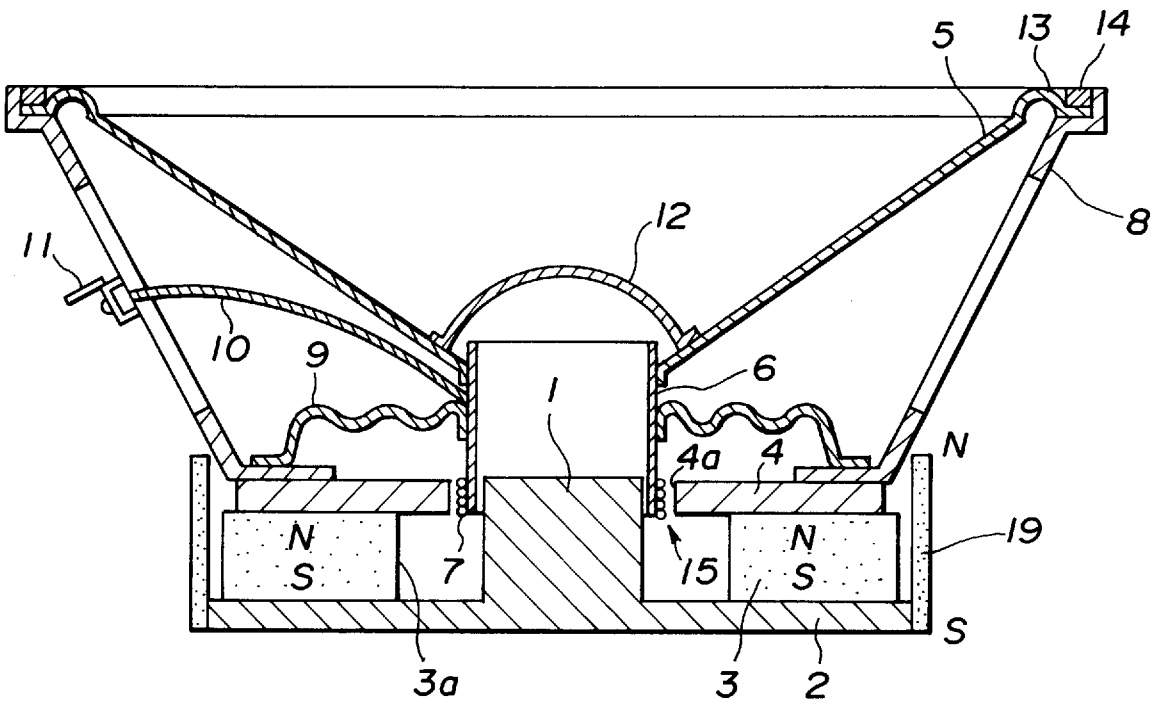
FIG. 4 is a longitudinal cross-section showing the structure of a speaker apparatus in which a canceling magnet is used simultaneously as the shield cover according to a third embodiment of the present invention.

FIG. 4 shows a third embodiment of the present invention, in which the parts or components similar to those shown in FIG. 2 are denoted by the same numerals and the corresponding description is omitted for simplicity. In the present third embodiment, shown in FIG. 4, the frame 8 is designed not to cover the driving magnet 3, yoke 2 or the top plate 4. Specifically, the rear end of the frame 8 is mounted on the front surface of the plate 4, while the canceling magnet 19 is secured to the outer periphery of the disc-shaped flange portion of the yoke 2. The driving magnet 3 is mounted on the front side of the yoke 2, which is larger in outside diameter than the driving magnet.

Figure 5:
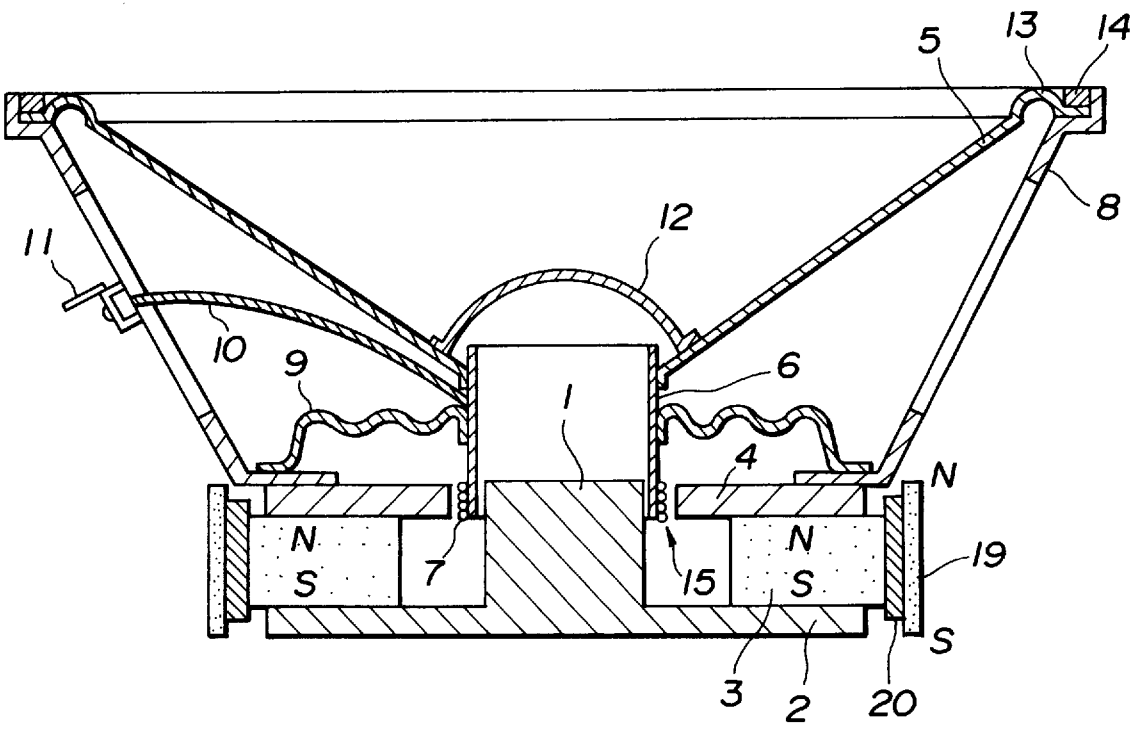
FIG. 5 is a longitudinal cross-section showing the structure of a speaker apparatus in which a canceling magnet is mounted via spacer on a driving magnet according to a fourth embodiment of the present invention.

FIG. 5 shows a modification of the third embodiment of the present invention. In FIG. 5, the parts or components similar to those shown in FIG. 4 are denoted by the same numerals and the corresponding description is omitted for simplicity. In the present fourth embodiment, shown in FIG. 5, the outside diameter of the driving magnet 3 is selected to be larger than that of the disc-shaped flange portion of the yoke 2, and the canceling magnet 19 is mounted on the outer periphery of the driving magnet 3 via a spacer 20 formed of synthetic resin, rubber or the cloth. In the present embodiment, similar to the third and fourth embodiments, it is possible to reduce the stray magnetic flux leaking to outside the speaker apparatus.

What is claimed is:

1. A speaker apparatus comprising:

a yoke formed of a magnetic material and having a flange portion and a center pole protruded integrally forward from a mid portion of said flange portion;

a ring-shaped driving magnet having a center aperture into which said center pole is inserted;

a top plate mounted on said driving magnet, said top plate being formed of a magnetic material and having a center opening into which said center pole is inserted, said top plate and said center pole defining a magnetic gap;

a diaphragm;

a bobbin secured to said diaphragm;

a voice coil mounted on said bobbin in said magnetic gap;

a canceling magnet arranged at an outer periphery of and spaced from said driving magnet at a pre-set spacing for covering said driving magnet and canceling magnetic flux leaking outside of a magnetic circuit including said driving magnet; and a frame holding one end of said diaphragm;

wherein said frame is not molded integrally with said top plate, said frame is molded integrally with said driving magnet for covering at least said driving magnet, and wherein said frame has an inner wall surface facing said diaphragm; and said canceling magnet is mounted to said inner wall surface of said frame facing said driving magnet and is spaced at a pre-set distance from said driving magnet for encircling said driving magnet.

* * * * *